US005540135A

United States Patent [19]

Goellner

[11] Patent Number: 5,540,135

[45] Date of Patent: Jul. 30, 1996

[54] DEVICE FOR CLAMPING AN AXIALLY MOVABLE ROD

[75] Inventor: Willy J. Goellner, Rockford, Ill.

[73] Assignee: Advanced Machine & Engineering Co., Rockford, Ill.

[21] Appl. No.: 363,934

[22] Filed: Dec. 27, 1994

[51] Int. Cl.[6] ..... F15B 15/26

[52] U.S. Cl. ..... 91/41; 92/28

[58] Field of Search ..... 91/41; 92/15, 23, 92/24, 27, 28, 29

[56] References Cited

U.S. PATENT DOCUMENTS

| | | | |
|---|---|---|---|
| 3,320,861 | 5/1967 | Johnson et al. | 92/29 X |
| 3,470,793 | 10/1969 | Hanchen . | |
| 3,575,087 | 4/1971 | Sherwood . | |
| 3,941,141 | 3/1976 | Robert | 92/24 X |
| 3,995,534 | 12/1976 | Rastetter . | |
| 4,078,778 | 3/1978 | Hubweber | 92/23 X |
| 4,185,539 | 1/1980 | Stratienko | 92/27 X |
| 4,463,481 | 8/1984 | Rastetter et al. . | |
| 4,699,355 | 10/1987 | Tomlin et al. | 92/24 X |
| 5,018,434 | 5/1991 | Haka | 92/29 |
| 5,302,062 | 4/1994 | Baba et al. . | |
| 5,361,680 | 11/1994 | Matsui | 92/29 X |

*Primary Examiner*—Hoang Nguyen
*Attorney, Agent, or Firm*—Vernon J. Pillote

[57] ABSTRACT

A device for clamping an axially movable rod comprising a housing having a cylindrical inner wall and end walls that slidably support the rod. A pair of annular rod clamp rings in the housing having inner clamping surfaces for engaging the rod and frusto-conical outer surfaces, and a pair of annular pistons in the cylinder having an inner surface engaging the outer surface on the annular rod clamp rings and an outer surface slidable in the cylindrical inner wall of the housing. The pistons have spring receiving cavities radially intermediate the inner and outer surfaces thereof and the springs disposed in the cavities for moving the pistons axially in a direction to clamp the rod. A fluid pressure chamber is provided in the cylinder for actuating the pistons in a direction to release the rod.

20 Claims, 3 Drawing Sheets

FIG. 7
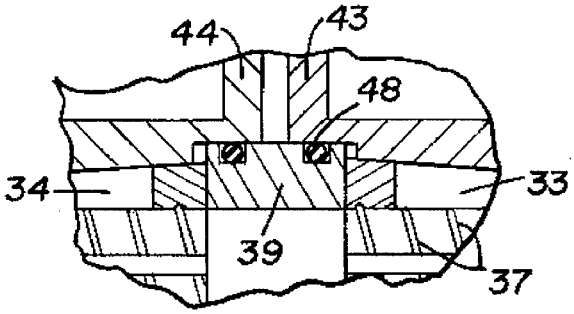
FIG. 8
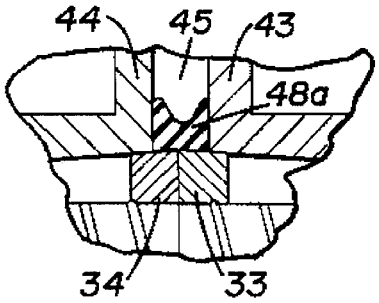
FIG. 9
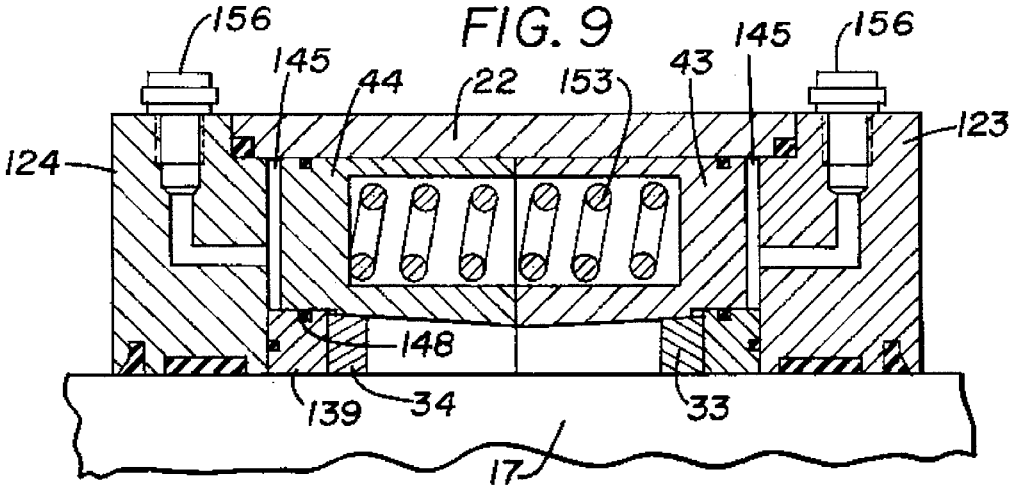
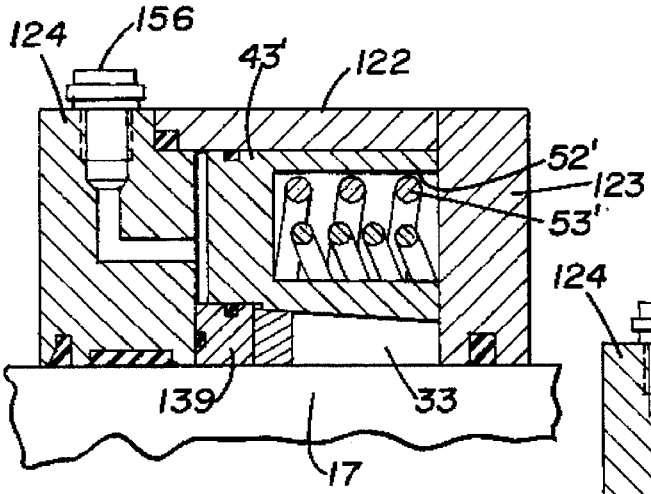
FIG. 11
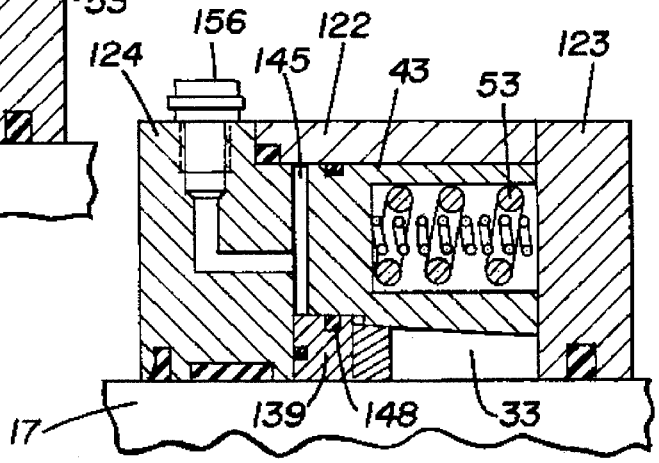
FIG. 10

DEVICE FOR CLAMPING AN AXIALLY MOVABLE ROD

BACKGROUND OF THE INVENTION

Various devices have heretofore been made for clamping an axially movable rod to hold it against movement relative to the clamp device and some of these clamp devices such as disclosed in U.S. Pat. Nos. 3,470,793; 3,575,087; 3,995,534; 4,463,481 and 5,302,062, disclose spring arrangements for normally urging the clamp device to one condition and fluid pressure operated means for moving the clamp device to a second condition. The rod clamp should be capable of clamping the piston rod in any extended condition of the rod. The length of the piston rod must be increased to accommodate the overall length of the clamp device, and it is accordingly desirable to minimize the overall length of the clamp device. In some installations, the fluid pressure available for actuating the clamp device is low, and difficulties have been encountered in providing a rod clamp device that can be reliably operated at low fluid pressures. Further, many prior rod clamp devices were expensive to manufacture and assemble.

SUMMARY OF THE INVENTION

Various objects of the present invention are to provide a device for clamping an axially movable rod which is compact in construction to minimize the increase in the length of the rod required to allow a full stroke of the rod; which can be economically manufactured and assembled and which is adaptable for actuation at low fluid pressure.

Accordingly, the present invention provides a device for clamping an axially movable rod comprising a housing having a cylindrical inner wall and end walls that slidably support the rod. Annular clamp ring means in the housing has an inner clamping surface for engaging the rod and a frusto-conical outer surface. An annular piston in the housing has a piston end face at one end and an axial passage extending through the piston. The axial passage has a major diameter end at the piston end of the cylinder and a frusto-conical inner surface engaging the outer surface on the annular clamp ring means. The piston means has spring receiving cavity means and spring means disposed in the cavity means for moving the piston means axially in a direction to clamp the rod. A fluid pressure chamber is provided in the cylinder for actuating the piston means in a direction to release the rod.

The rod clamp device may comprise a single annular clamp ring and a single annular piston. Preferably, the annular rod clamp device comprises a pair of annular clamp rings having frusto-conical outer surfaces and a pair of pistons that engage the frusto-conical outer surfaces on the annular clamp rings. Springs yieldably urge the pistons in directions to actuate the clamp rings into rod clamping condition and fluid pressure chambers are arranged to actuate the pistons to a release condition.

BRIEF DESCRIPTION OF THE DRAWINGS

FIG. 7 is a fragmentary longitudinal sectional view on a larger scale than FIG. 2 illustrating inner piston seal arrangement;

FIG. 8 is a fragmentary longitudinal sectional view illustrating a modified inner piston seal arrangement;

FIG. 9 is a fragmentary longitudinal sectional view illustrating a third embodiment of the rod clamp;

FIG. 10 is a fragmentary longitudinal sectional view illustrating a fourth embodiment of the rod clamp using a single piston; and FIG. 11 is a fragmentary longitudinal sectional view illustrating a modified single piston type rod clamp.

DETAILED DESCRIPTION

Figure 1:
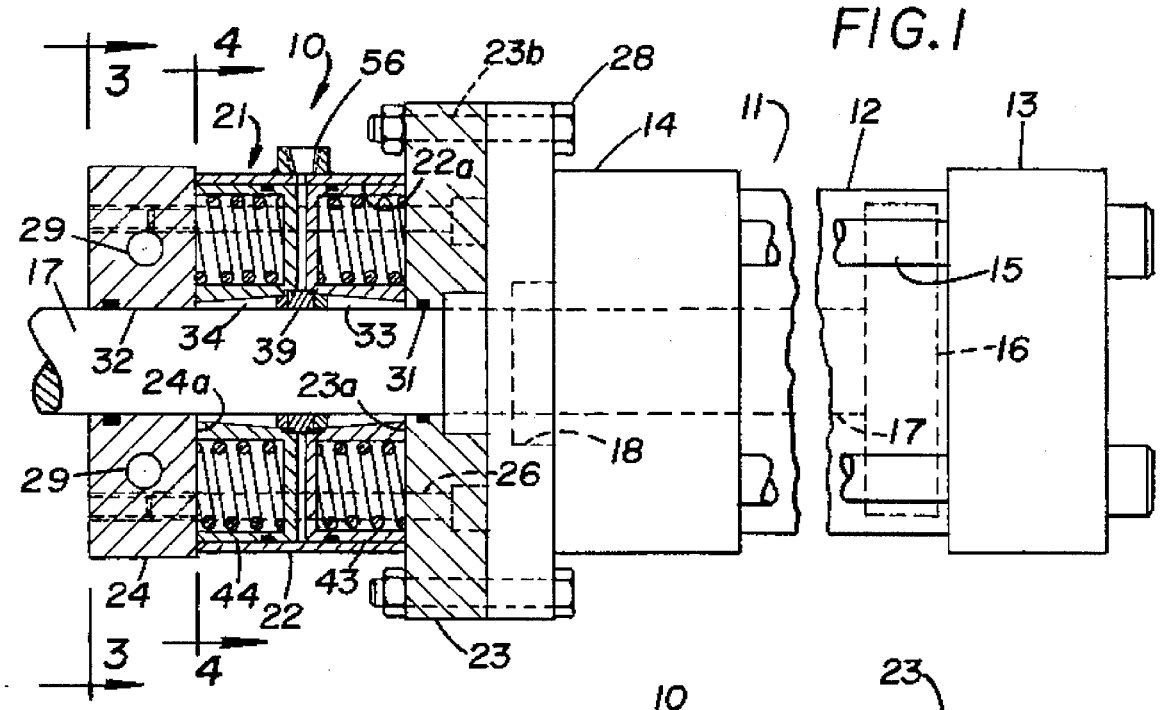
FIG. 1 a longitudinal sectional view through the rod clamp attached to a fluid actuated cylinder.

The rod clamping device designated generally by the numeral 10 is shown in FIG. 1 applied to a fluid actuator 11. As is conventional, the fluid actuator 11 includes a cylinder 12 and heads 13 and 14 secured to opposite ends of the cylinder as by rods 15. A piston 16 is slidable in the cylinder and has a piston rod 17 extending out through a seal 18 in one of the heads 14. The length of the cylinder is selected to accommodate the desired stroke of the piston rod and the fluid actuators are available in different cylinder and piston rod sizes for different applications.

Figure 3:
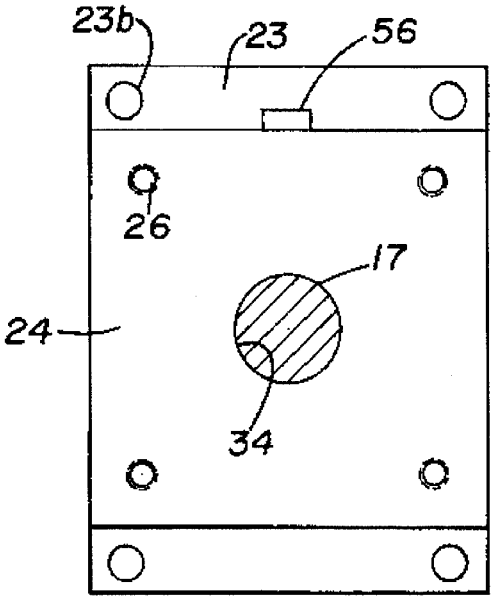
FIG. 3 is an end view of the rod clamp, taken on the plane 3—3 of FIG. 1.
Figure 4:
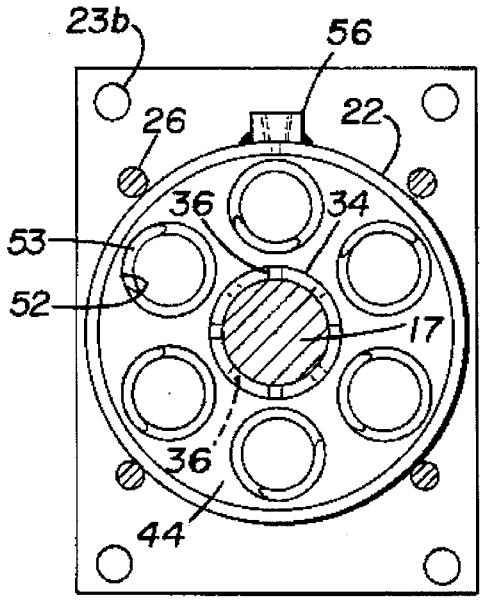
FIG. 4 is a transverse sectional view through the rod clamp, taken on the plane 4—4 of FIG. 1.

The rod clamp 10 comprises a housing having a cylindrical inner wall and end walls. The housing is preferably formed in three pieces with a cylinder member 22, and first and second end members 23 and 24 at opposite ends of the cylinder. The end members 23 and 24 are clamped to opposite ends of the cylinder 21 by tie bolts 26 and the tie bolts are arranged as shown in FIGS. 3 and 4 so as to extend closely adjacent the outer periphery of the cylinder member 22 to aid in radially locating the cylinder member. One of the end members 23 is adapted for direct attachment to one of the heads 14 on the pneumatic actuator and is herein shown provided with openings **23*b* at locations to align with the corresponding openings in the header 14 to receive mounting fasteners 28. The end member 24 is provided with bolt openings 29 to enable side mounting of the pneumatic actuator and rod clamp unit. Alternatively, the pneumatic actuator can be mounted on the equipment and the rod clamp supported solely by attachment to the head 14** on the pneumatic actuator.

Figure 2:
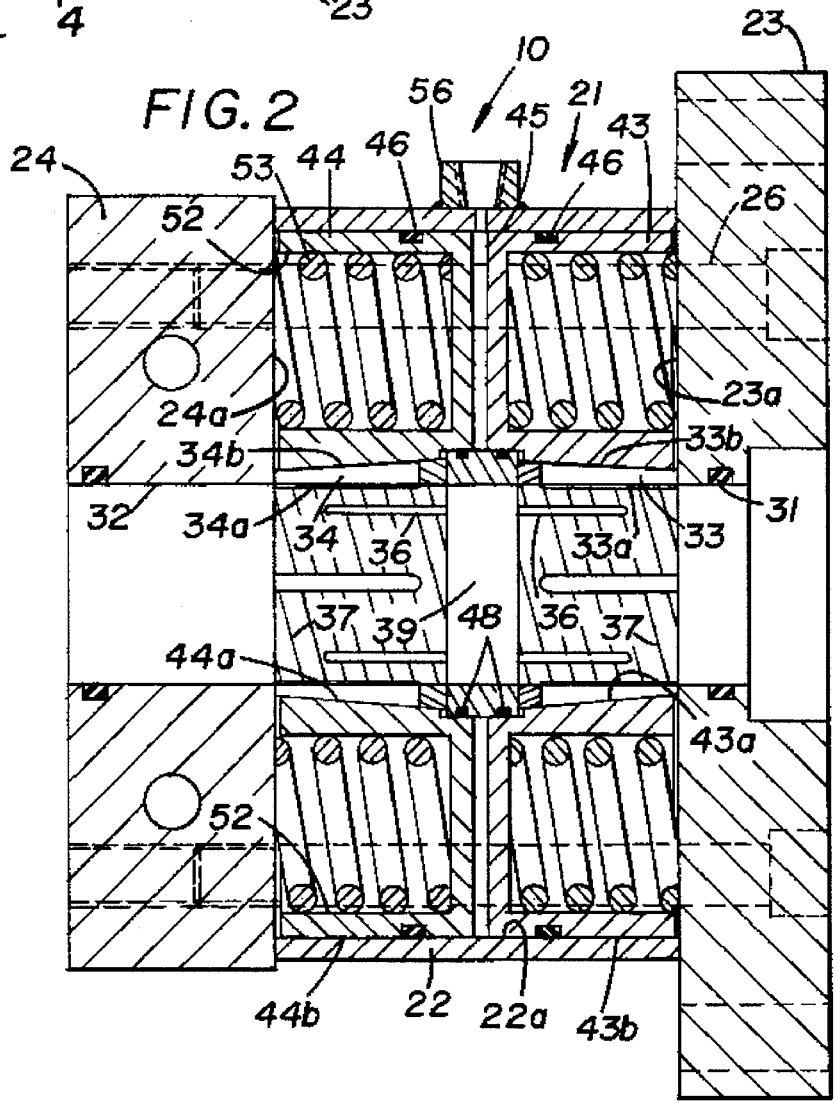
FIG. 2 is a longitudinal sectional view through the rod clamp on a larger scale than FIG. 1.

The piston rod 17 extends through openings 31, 32 in the end members 23, 24. The rod clamp has annular clamp means for engaging the rod and annular piston means surrounding the annular clamp means for actuating the latter into and out of engagement with the rod. The annular clamp means preferably comprises first and second annular clamp rings 33 and 34 having generally cylindrical inner surfaces for engaging the shaft 17 and frusto-conical or tapered outer surfaces. The clamp rings 33 and 34 are constructed and arranged to be radially expansible and contractable and, as best shown in FIG. 2 are provided with a plurality of lengthwise extending slots 36 that extend inwardly from opposite ends. It is also contemplated that at least one of the slots in each annular clamp ring could extend the full axial length of the clamp ring for greater radial flexibility.

In the embodiment of FIGS. 1–6, the annular clamp rings 33 and 34 are arranged with their minor diameter ends adjacent the respective end members 23, 24, and a spacer ring 39 is interposed between the major diameter ends of the clamp rings and dimensioned such that the clamp rings are constrained against axial movement between the end members 23 and 24. Spiral grooves 37 are preferably provided on the interior of the clamp rings as shown in FIGS. 2, 7 and 8, to allow escape of oil.

First and second annular pistons 43 and 44 are slidable in cylinder 22 and each have a piston end face at one end and a second end face at an opposite end and an axial passage 43*a*, 44*a* extending between the end faces. The passage has a major diameter end at the piston end face and a frusto-conical inner surface complimentary to and engaging the frusto-conical outer surface on a respective one of the clamp rings 33 and 34. In the embodiment of FIGS. 1–6, the clamp rings 33 and 34 are arranged with their major ends adjacent the center of the cylinder and the pistons have piston end faces in opposed relation. A single fluid pressure chamber 45 is formed in the cylinder between the piston end faces of the pistons 43 and 44. O-rings 46 are provided in grooves in the outer periphery of the annular pistons 43 and 44 to provide a sliding seal between the pistons and the cylinder wall. As best shown in FIG. 7, cylindrical wall portions are provided at the major diameter ends of the frusto-conical inner surfaces in the pistons 43 and 44 for slidably engaging seal rings 48 provided in the spacer ring 39.

The annular pistons 43 and 44 are spring actuated in a direction to clamp the piston rod 17 against axial movement by springs interposed between the pistons and the associated end wall of the housing and the pistons are actuated to a rod release condition in response to fluid pressure introduced through fitting 56 into the chamber 45. The pistons each have spring cavity means extending into the second end and compression type springs are disposed in the spring cavities, with one end engaging the inner side of the piston and the other end engaging the associated end wall. In the embodiment of FIGS. 1–4, the pistons are formed with a plurality of annularly spaced spring receiving cavities 52, for example 4–6 cavities, and the spring means comprises a plurality of coil-type compression springs 53 ground flat at the ends such as are commonly used as die springs.

The strength of the springs that can be used to apply clamping force is limited by the fluid pressure available to actuate the pistons to a release condition against the bias of the springs. The clamping force exerted by the clamp rings on the rod increases as the taper on the outer surfaces of the clamp rings is decreased. However, as the taper on the outer surface of the clamp rings is decreased, the travel of the piston required between the clamp and release positions correspondingly increases. Accordingly, when the angle of the taper of the clamp rings is relatively low, for example 4 degrees, the springs 53 are preferably of the coil-type having flat ends, such as are used as die springs, and which provide a more uniform spring force during expansion. If desired, two or more coil type compression springs can be provided in each spring cavity, for example as shown in FIG. 10.

Figure 5:
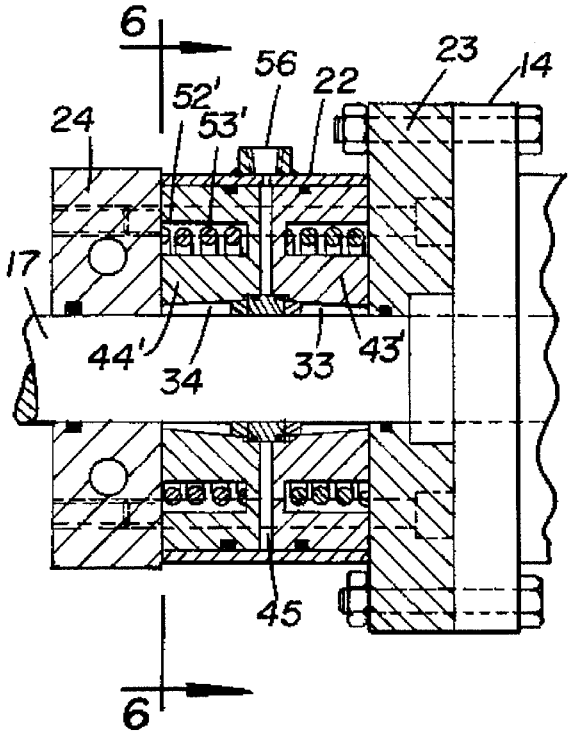
FIG. 5 is a longitudinal sectional view through a second embodiment of the rod clamp.
Figure 6:
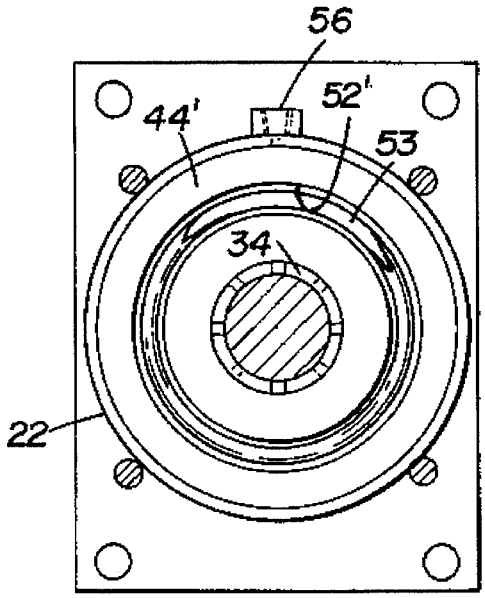
FIG. 6 is a transverse sectional view taken on the plane 6—6 of FIG. 5.

A modified form of the rod clamp is illustrated in FIGS. 5 and 6 and like numerals are used to designate the same parts with like numerals followed by the postscript ' used to designate modified parts. In this embodiment the housing including the cylinder member 22 and end members 23 and 24 are the same and the clamp rings 33 and 34 are also preferably the same as that previously described. The pistons 43' and 44' are each provided with a single annular spring receiving cavity 52' concentric with the rod and spaced radially outwardly of the tapered inner surface of the piston. The cavity 52' opens at the second end of the piston and an annular spring assembly is provided for yieldably urging the pistons to a clamp condition. As shown in FIGS. 5 and 6, the spring 53' is a coil-type compression spring concentric with the piston axis and extends into the cavity 52' in each piston with one end engaging the inner side of the piston and the other end engaging an end wall to yieldably urge the pistons to a clamp condition. For greater spring pressure, two or more concentric springs can be used, for example as shown in FIG. 11.

FIG. 8 illustrates a modified arrangement for sealing the inner periphery of the annular pressure chamber 45 disposed between the pistons 43 and 44. Instead of the dual O-ring and spacer ring construction as shown in FIG. 7, a single annular seal ring 48*a* is disposed around the adjacent ends of the clamp rings 33 and 34 and between the pistons 43 and 44. The single seal ring preferably has an outer periphery of V-configuration so that fluid pressure in the chamber 45 presses the sides of the seal ring into sealing engagement with the piston end faces and also presses the seal ring radially into sealing engagement with the clamp rings.

In the embodiment of FIG. 9, the clamp rings 33 and 34 are arranged with the minor diameter ends adjacent each other and the pistons 43, 44 are arranged with the piston end faces adjacent the end members 23, 24 and with the ends of the spring cavities in the pistons disposed in opposed relation. With this arrangement, a single spring can be disposed in an opposed pair of spring receiving cavities. In FIG. 9, the pistons each have a plurality of annularly spaced spring receiving cavities and one or more coil type compression springs 153 are disposed within each opposed pair of cavities. The pistons can also be formed with a single spring receiving cavity concentric with the piston, for example as shown in FIGS. 5, 6 and 11, and one or more coil type springs can be disposed in the opposed cavities. When the piston end faces of the pistons are disposed adjacent the end members 23 and 24, the fluid pressure inlets 156 must be arranged to supply a fluid pressure to the pressure chamber 145 at the piston face end of each piston.

The embodiment of FIG. 10 is similar to that illustrated in FIGS. 1–4, but has only a single clamp ring 33 and a single piston 43. In this embodiment, one or more concentric coil type compression springs 53 are disposed in each of the spring receiving cavities. The face end of the piston is sealed at its outer periphery to the cylinder 22 by an O-ring and at its inner periphery by an O-ring 148 disposed in a spacer ring 139. The spacer ring is sealed to end member 124 by an O-ring. A fluid inlet 156 is provided to communicate with the fluid pressure chamber 145 at the head end of the piston.

The embodiment of FIG. 11 is similar to that shown in FIGS. 5 and 6 but differs in that it has only a single clamp ring and single piston. It also differs from the embodiment of FIG. 10 in that the piston has a single annular spring receiving recess 52'. One or more coil springs 53' concentric with the piston axis are disposed in the single spring receiving recess for yieldably urging the piston to a clamping position.

From the foregoing it will be seen that the pistons are coaxial with the clamp rings and substantially axially coextensive therewith and that the actuating springs are disposed in the cavities in the pistons. This provides an axially compact arrangement for clamping the rod of the fluid actuator and minimizes the additional rod length that is required when the rod clamp is used on a fluid actuator. The spring receiving cavities can extend the major axial extent of the pistons to accommodate coil-type compression springs and reduce the change in spring force that occurs on movement of the pistons between extended and retracted positions.

The embodiments of the invention in which an exclusive property or privilege is claimed are defined as follows:

1. A device for clamping an axially movable rod comprising a housing having a cylindrical inner wall and first and second end walls and passages extending through the end walls coaxial with the cylindrical inner wall for slidably receiving the rod, at least one annular clamp ring means disposed between the end walls and having a generally cylindrical inner clamping surface for engaging the rod and a generally frusto-conical outer surface, at least one annular piston having a piston end face adjacent one end of said one annular clamp ring means and a second end face adjacent an opposite end of said one annular clamp ring means, the piston having an outer surface slidably received in the cylindrical inner wall and an axial inner passage between the end faces, the inner passage having a major diameter end opening at said piston end face and a frusto-conical inner surface that tapers inwardly in a direction toward said second end face for engaging the outer surface on the annular clamp ring means, the piston having spring receiving cavity means opening at said second end face of the piston, spring means disposed in the cavity means for moving the piston axially in one direction of the cylindrical inner wall, piston seal means for providing a pressure chamber inside the cylindrical inner wall at the piston end face of the piston, and passage means communicating with the pressure chamber for supplying fluid under pressure thereto for moving the piston means in a direction opposite said one direction.

2. A device according to claim 1 wherein said spring receiving cavity means in the piston comprises an annular cavity coaxial with the piston.

3. A device according to claim 1 wherein said spring receiving cavity means in the piston comprises a plurality of cavities arranged in a circular locus coaxial with the piston.

4. A device according to claim 1 wherein said housing comprises a cylindrical member having said cylindrical inner wall, and first and second end members clamped to opposite ends of said cylindrical member.

5. A device for clamping an axially movable rod comprising, a housing having a cylindrical inner wall and first and second end walls and passages extending through the end walls coaxial with the cylindrical inner wall for slidably receiving the rod, annular clamp ring means disposed between the end walls and having a generally cylindrical inner clamping surfaces for engaging the rod and first and second generally frusto-conical outer surfaces tapering in relatively opposite directions, a first annular piston having a piston end face adjacent one end of the first frusto-conical outer surface and a second end face adjacent an opposite end of the first frusto-conical outer surface, a second annular piston having a piston end face adjacent one end of the second frusto-conical outer surface and a second end face at an opposite end of the second frusto-conical outer surface, the pistons having an outer surface slidable in the cylindrical inner wall and an axial inner passage extending between the end faces, the inner passage in the first and second pistons having a major diameter end opening at the piston end face and a frusto-conical inner surface that tapers inwardly in a direction toward said second end face for respectively engaging the frusto-conical first and second outer surfaces on the annular clamp ring means, the piston members each having spring cavity means opening at the second end face, spring means in the spring cavity means in the first and second pistons for moving the first and second pistons in relatively opposite directions, piston seal means for providing a pressure chamber inside the cylindrical inner wall at the piston end face of each piston, and passage for supplying fluid under pressure to the pressure chamber.

6. A device according to claim 5 wherein said annular clamp ring means includes first and second clamp rings respectively having said first and second frusto-conical outer surfaces.

7. A device according to claim 6 wherein said first and second annular clamp rings have axially extending slots extending inwardly from at least one end thereof.

8. A device according to claim 5 wherein said spring receiving cavity means in each piston comprises a plurality of cylindrical cavities arranged in a circular locus coaxial with the piston.

9. A device according to claim 5 wherein said spring receiving cavity means in each piston comprises an annular cavity coaxial with the piston.

10. A device according to claim 5 wherein said housing comprises a cylindrical member having said cylindrical inner wall, and first and second end members clamped to opposite ends of said cylindrical member.

11. A device according to claim 5 wherein said pistons are each formed of plastic material.

12. A device for clamping an axially movable rod comprising, a housing having a cylindrical inner wall and first and second end walls and passages extending through the end walls coaxial with the cylindrical inner wall for slidably receiving the rod, annular clamp ring means disposed between the end walls and having a generally cylindrical inner clamping surfaces for engaging the rod and first and second generally frusto-conical outer surfaces tapering from a major diameter intermediate the end walls to a minor outer diameter adjacent the end walls, a first annular piston having a piston end face adjacent one end of the first frusto-conical outer surface and a second end face adjacent an opposite end of the first frusto-conical outer surface, a second annular piston having a piston end face adjacent one end of the second frusto conical outer surface and second end face adjacent an opposite end of the second frusto-conical outer surface, the pistons having an outer surface slidable in the cylindrical inner wall and an axial inner passage extending between the end walls, the inner passage in the first and second pistons having a major diameter end opening at said piston end face and a frusto-conical inner surface that tapers inwardly in a direction toward the second end face for respectively engaging the frusto-conical first and second outer surfaces on the annular rod clamp means, the piston members each having spring cavity means opening at the second end face, the first and second pistons having the piston end faces disposed in opposed relation, first spring means in the spring cavity means in the first piston and engaging the first end wall of the housing for moving the first spring means axially in a direction toward the second piston, second spring means in the spring cavity means in the second piston and engaging the second wall for moving the second piston axially toward the first piston, piston seal means for providing a pressure chamber inside the cylindrical inner wall between the piston end faces on the first and second pistons, and passage means for supplying fluid under pressure to the pressure chamber.

13. A device according to claim 12 wherein said spring receiving cavity means in each piston comprises a plurality of cylindrical cavities arranged in a circular locus coaxial with the piston.

14. A device according to claim 12 wherein said spring receiving cavity means in each piston comprises an annular cavity coaxial with the piston.

15. A device for clamping an axially movable rod comprising, a housing having a cylindrical inner wall and first and second end walls and passages extending through the end walls coaxial with the cylindrical inner wall for slidably receiving the rod, annular clamp means disposed between the end walls and having generally cylindrical inner clamping surfaces for engaging the rod and first and second generally frusto-conical outer surfaces tapering from a major outer diameter adjacent the end walls to a minor outer diameter intermediate the end walls, a first annular piston having a piston end face adjacent one end of the first frusto-conical outer surface and a second end face adjacent a second end of the first frusto-conical outer surface, a second annular piston having a piston end face adjacent one end of the second frusto-conical outer surface and a second end face adjacent an opposite end of the second frusto-conical outer surface, the pistons having an outer surface slidable in the cylindrical inner walls and an axial inner passage extending between the end walls, the inner passage in the first and second pistons having a major diameter end opening at the piston end face and a frusto-conical inner surface that tapers inwardly in a direction toward the second end face for respectively engaging the frusto-conical first and second outer surfaces on the annular rod clamp means, the piston members each having spring cavity means opening at the second end face, the first and second pistons having the second end faces disposed in opposed relation, spring means extending into the spring cavity means in the first and second pistons for moving the pistons in relatively opposite directions respectively toward the first and second end walls, piston seal means providing first and second pressure chambers inside the cylindrical inner wall at the piston end faces of the first and second pistons respectively, and passage for supplying fluid under pressure to the first and second pressure chambers.

16. A device according to claim 15 wherein said spring receiving cavity means in each piston comprises a plurality of cylindrical cavities arranged in a circular locus coaxial with the piston.

17. A device according to claim 15 wherein said spring receiving cavity means in each piston comprises an annular cavity coaxial with the piston.

18. A device for clamping an axially movable rod comprising a housing having a cylindrical inner wall and first and second end walls and passages extending through the end walls coaxial with the cylindrical inner wall for slidably receiving the rod, an annular clamp ring means disposed between the end walls and having a generally cylindrical inner clamping surface for engaging the rod and a generally frusto-conical outer surface, an annular piston having a piston end face adjacent one end of the annular clamp ring means and a second end face adjacent an opposite end of the annular clamp ring means, said piston having an outer surface slidably received in the cylindrical inner wall and an axial inner passage between the end faces, the inner passage having a major diameter end opening at said piston end face and a frusto-conical inner surface that tapers inwardly in a direction toward said second end face for engaging the outer surface on the annular clamp ring means, the piston having spring receiving cavity means opening at said second end face of the piston, spring means disposed in the cavity means for moving the piston axially in one direction of the cylindrical inner wall, piston seal means for providing a pressure chamber inside the cylindrical inner wall at the piston end face of the piston, and passage means communicating with the pressure chamber for supplying fluid under pressure thereto for moving the piston means in a direction opposite said one direction.

19. A device according to claim 18 wherein said spring receiving cavity means in the piston comprises an annular cavity coaxial with the piston.

20. A device according to claim 18 wherein said spring receiving cavity means in each piston comprises a plurality of cylindrical cavities arranged in a circular locus coaxial with the piston.

* * * * *